United States Patent [19]

Hwang

[11] Patent Number: 4,896,308

[45] Date of Patent: Jan. 23, 1990

[54] DIGITAL CLOCK FOR GIVING ACOUSTIC TIME-INDICATING SIGNALS AT PREDETERMINED MOMENTS

[76] Inventor: Huoy J. Hwang, No. 53, Chi Shan I St., 23 Lin, Hsiang Lu Tsun, Ta Li Hsiang, Taichung Hsien, Taiwan

[21] Appl. No.: 366,454

[22] Filed: Jun. 15, 1989

[51] Int. Cl.[4] ..... G04B 21/02; G04B 19/16

[52] U.S. Cl. ..... 368/75; 368/251; 368/273

[58] Field of Search ..... 368/71–75, 368/272–273

[56] References Cited

U.S. PATENT DOCUMENTS

| | | | |
|---|---|---|---|
| 4,293,940 | 10/1981 | Noguchi et al. | 368/75 |
| 4,370,069 | 1/1983 | Nomura | 368/273 |
| 4,459,036 | 7/1984 | Sado et al. | 368/251 |
| 4,472,065 | 9/1984 | Goodman | 368/75 |
| 4,472,069 | 9/1984 | Yamamoto | 368/251 |

*Primary Examiner*—Vit W. Miska
*Attorney, Agent, or Firm*—Bernard R. Gans

[57] ABSTRACT

A digital clock for giving acoustic time-indicating signals having an oscillator, a time integrated circuit driven by the oscillator, a first display element connected to the time integrated circuit to show hour and minute and, a second display element connected to the time integrated circuit to show a day among a week. A minute and a hour decoders are connected to the first display element to convert signals into a form of binary code. A memory unit receives the signals from the minute and hour decoders. A setting circuit has a number of flip-flops and control switches to be connected to inputs of the memory unit to pre-set a moment for giving acoustic time-indicating signals. An acoustic generator and a driving interface are connected to respective outputs of the memory unit and are driven by the memory unit to output the time-indicating signals.

3 Claims, 4 Drawing Sheets

DIGITAL CLOCK FOR GIVING ACOUSTIC TIME-INDICATING SIGNALS AT PREDETERMINED MOMENTS

The present invention relates to a clock for giving acoustic signals at predetermined moments, and more particularly, relates to a digital clock comprising a time integrated circuit connected to first and second decoders, the outputs of which are connected to a memory unit. The output of the memory unit are connected to respective acoustic circuits for producing acoustic time-indicating signals ate predetermined moments.

Heretofore, time-indicating clocks have been mechanically controlled, and have comprised a clock associated with a dial having a plurality of, say twelve, equidistantly spaced-slots for mounting a corresponding number of pins. When a pin mounted on the dial reaches a certain position, it touches a switch and thus a sound-producing circuit provided within the time-indicating clock is actuated to produce acoustic signals. The shortcomings in these mechanically-controlled time-indicating clocks are as follows:

1. Special techniques are required to mount the pins on the dial, therefore it is inconvenient for the user when the original predetermined moment has to be altered;

2. Since the time-indicating clocks are mechanically controlled, they cannot produce signals only in some selected days. In other words, they produce acoustic signals not only in weekdays, but also on Sundays, when such signals are not necessary. This not only wasting the power but also bothers the neighbors (in close housing conditions);

3. After a power interruption, it is necessary to re-adjust the position of the pins on the dial; and 4. The smallest unit for setting the signaling moment on the dial is limited to five minutes which is the distance of two adjacent pins, and it is not adaptable to some applications when a higher accuracy (i.e., a finer subdivision with each interval less that five minutes) is required.

It is therefore a primary object of the present invention to mitigate and/or obviate the above-mentioned drawback and disadvantage by providing a digital clock which gives acoustic signals at predetermined moments.

Further objective and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
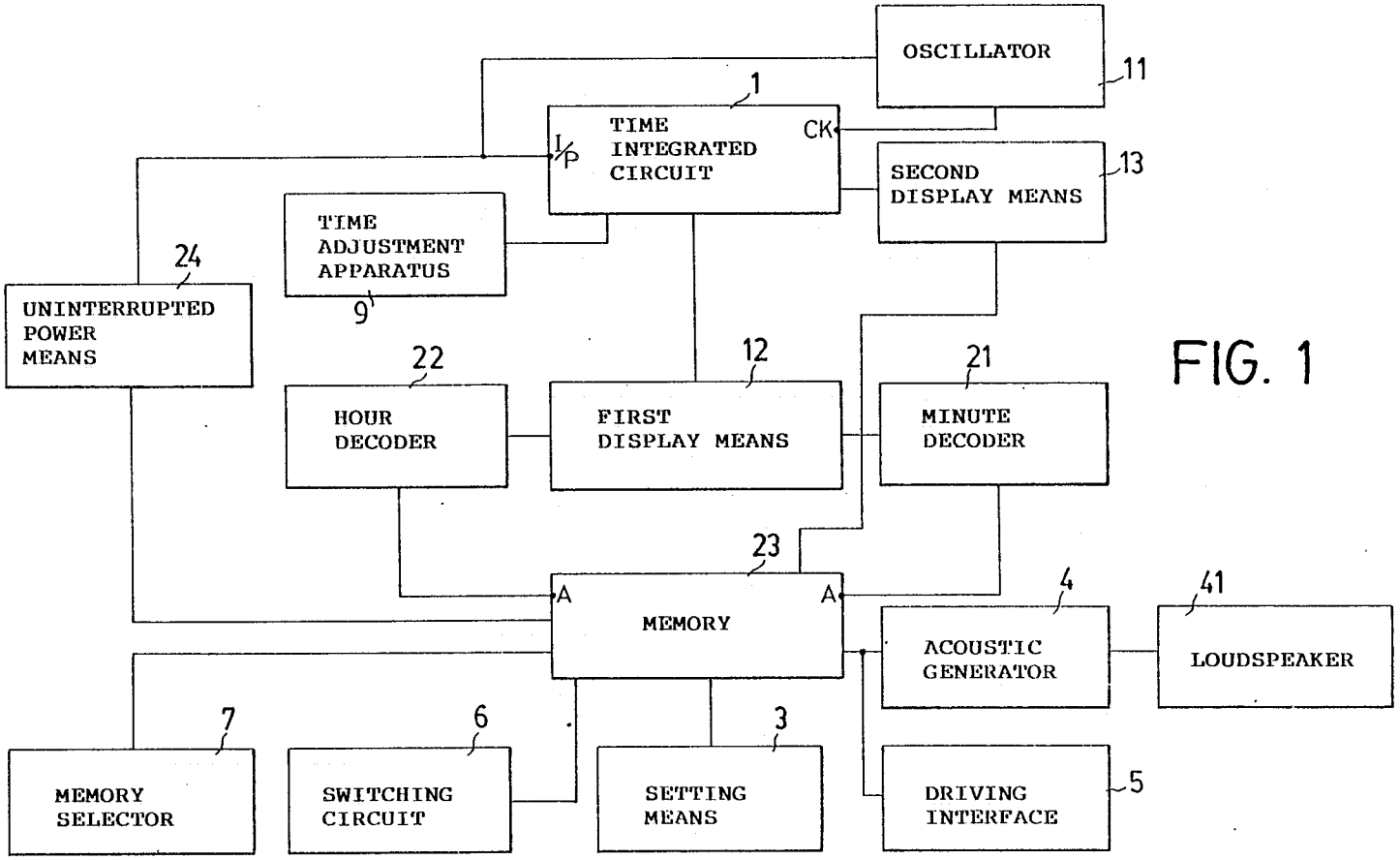
FIG. 1 is a functional block diagram of a clock in accordance with the present invention.

With reference to the drawings and in particular to FIG. 1 thereof, it can be seen that a digital clock for giving acoustic time-indicating signals in accordance with the present invention comprises an oscillator 11, a time integrated circuit 1 driven by the oscillator 11, a first display means 12 connected to the time integrated circuit 1 to show hour and minute data and a second display means 13 connected to the time integrated circuit 1 to show the data of the seven days in a week.

Minute and hour decoders 21 and 22 which are connected to the first display means 12 convert signals therefrom into a form of binary code, and then send the converted binary signals into address buses of a memory unit 23. A setting circuit 3 is connected to an input port of the memory unit 23 to pre-set the moment for giving acoustic time-indicating signals. An acoustic generator 4 and a driving interface 5 which are connected to respective output ports of the memory unit 23 are driven thereby the produce the time-indicating signals when the time shown on the first display means 12 is the same as the moment pre-set in the memory unit 23.

The output of the second display means 13 is further connected to a switching circuit 6 which is connected to a control pin of the memory unit 23 to disable the memory unit 23 during the day which is shown on the second display means 13 (i.e., when there is no need for time-indication); for example, Sunday.

A memory supporting means 24 is connected to the time integrated circuit 1, the oscillator 11 and the memory unit 23 to prevent the data stored therein from being lost during an unexpected power interruption.

Figure 2:
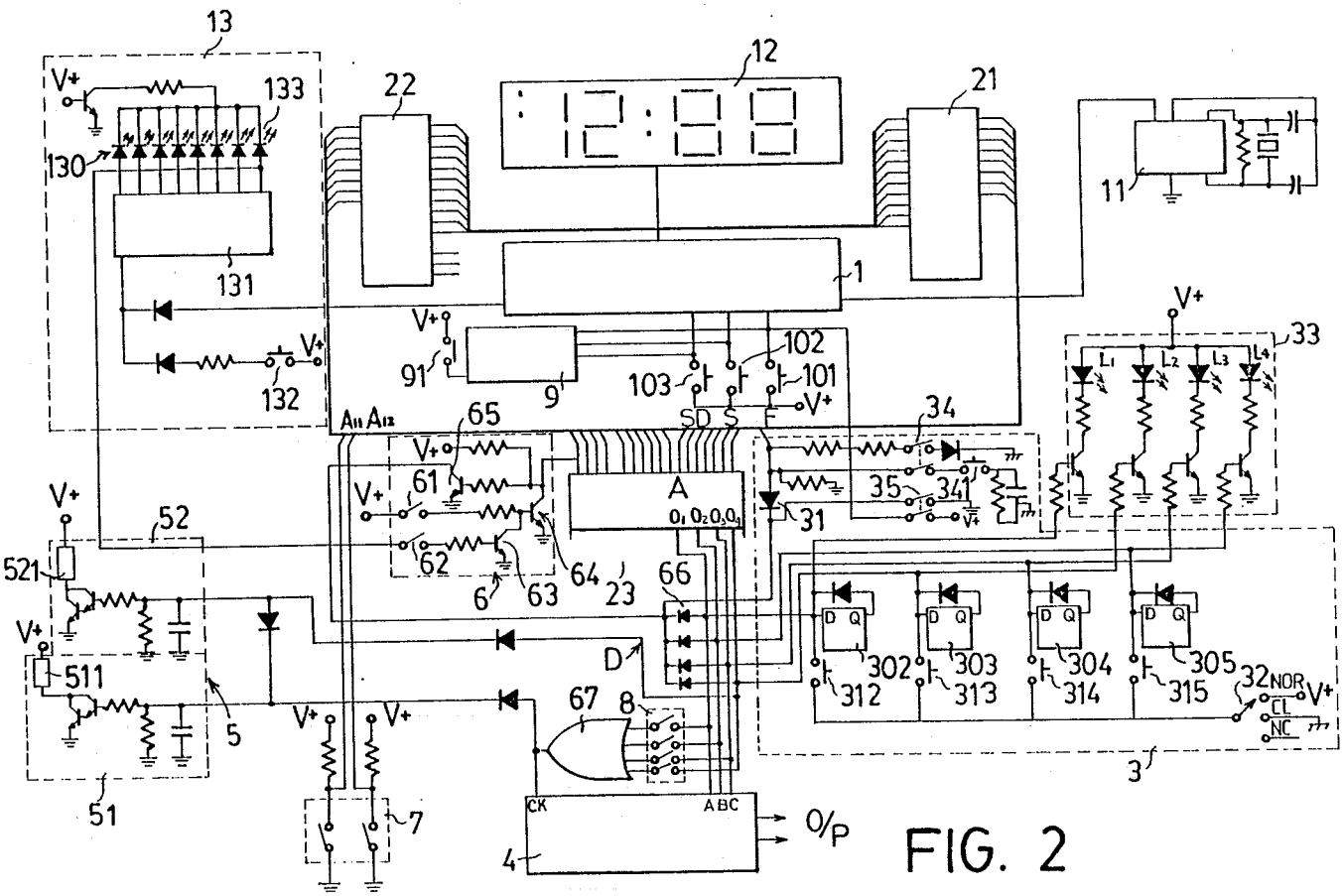
FIG. 2 is a circuit diagram of the clock of FIG. 1.

Particularly referring to FIG. 2, a circuit diagram of a preferred embodiment of the digital clock is shown to describe this invention in detail. As mentioned heretofore, the signals sent to the first display means 12 are respectively sent to the address inputs of the minute and hour decoder 21 and 22, the outputs of which are connected to the address inputs of the memory unit 23. A plurality of time-setting switches 101 to 103 are connected to the time integrated circuit for manual adjustment of the time shown on the first and second display means 12 and 13. The first time-setting switch 101 is used to rapidly set the predetermined moment for coarse adjustment, the second time-setting switch 102 is used to slowly set the predetermined moment for time adjustment, and the third time-setting switch 103 is used to adjust the position of the longest (second) hand of the clock. Moreover, a time ajdustment appartus 9 is connected to the time-setting switches 101 to 103 to associate this invention to another clock mechanism to synchronize this device with the latter, for example, a time clock. The time adjustment apparatus 9 is connected to an actuating contact 91 of the clock mechanism, which is set to be switched on at midnight. When the actuating contact 91 is switched on, the time-setting switches 101 to 103 are in high level and the time is adjusted to 0:00 at midnight, so that the clock of this invention is synchronized with the clock mechanism.

An output of the time integrated circuit 1 is connected to a counter 131 of the second display means 13 as the pulse input, wherein a plurality of LEDs (light emitting diodes) 130 are provided to show the day of a week. It should be noted that the period of the pulse signals sent to the counter 131 is once per day and the day shown on the second display means 13 is adjustable by a button 132.

The switching circuit 6 comprises a plurality of transistor 63 to 65 and two switches 61 and 62, which respectively enable or disable the memory unit 23. Switch 61 is electrically disposed between a power supply and the base of the second transistor 64, the collector of which is connected to a control pin of the memory unit 23. When switch 61 is manually switched off, the second transistor 64 is broken and the control pin of the memory unit 23 is in high level so that the memory unit 23 is disabled. Switch 62 is disposed between one output 133 of the second display means 13 and the base of the first transistor 63, the collector of which is connected to the base of the second transistor 64 and which is actuated by the output 133 when switch 62 is switched on. If the output 133 of the second display means 13 is in high level (i.e., there is no need for time-indicating when the output 133 is conducted), the first transistor 63 is conducted and the second transistor 64 is broken, so that the memory unit 23 is disabled.

The setting circuit 3 comprises a plurality of (in this exemplary case, four) flip-flops 302 to 305 and two control switches 34 and 35. The output (Q) of each flip-flop 302 to 305 is connected to the input (D) thereof via a diode for writing the predetermined moment into the memory unit 23. The inputs (D) of the flip-flops 302 to 305 are electrically connected to respective outputs of the memory unit 23 and connected to a setting switch 32 via respective setting buttons 312 to 315. Moreover, a third display means 33 is provided to show the state of the flip-flops 302 to 305, which has a plurality of LEDs (L1, L2, L3 and L4) associated with respective transistors to connect the respective inputs D of the flip-flops 302 to 305. When the setting switch 32 is connected to a power supply, a push on the setting buttons 312 to 315 not only lights up the respective LEDs (L1, L2, L3 and L4), but also enables the writing of the desired moment into the memory unit 23.

A terminal of the first control switch 34 is respectively connected to the input of read/write of the memory unit 23 and the collector of the third transistor 65 of the switching circuit 6 via a diode 31, the base of which is connected to the control pin of the memory unit 23. The other terminal of the first control switch 34 branches into two contact points. The first contact point of the first control switch 34 is connected to a write-in button 341 which is grounded via an RC circuit, and the second contact point thereof is grounded via a diode. Similar to the first control switch 34, the second control switch 35 has two contact points. The first contact point of the second control switch 35 is disposed between the time-setting switch 101 and a power supply. A terminal of the second contact point of the second control switch 35 is reversely connected to the diode 31 and is connected to the control pin of the memory unit 23, and the other terminal thereof is grounded.

The switch-on of the first control switch 34 and the write-in button 341 enable the memory unit and set the memory unit 23 write-in state. The setting of the predetermined moment for time-indicating signals is achieved by pushing the setting buttons 312 to 315 in a condition that the setting switch 32 is connected to the power supply. The switch-on of the second control switch 35, after the switching on of the first control switch 34, enables the rapid adjustment of time of the time integrated circuit 1 and sets the inputs of read/write of the memory unit 23 in low level to write the predetermined moment therein.

A memory unit selector means 7 having two switches is provided to connect address buses A11 and A12 of the memory unit 23 to enlarge the memory capacity. For example, if the memory unit 23 has four storage blocks, then there are sixteen storage blocks to store the data while the memory unit 23 is in association with the memory selector means 7.

The acoustic generator 4 has a plurality of music software programs stored therein with a corresponding plurality of inputs (A, B, and C) each of which respectively corresponds to one of the music software programs and is connected to respective outputs (01, 02 and 03) of the memory unit 23.

The driving interface 5 has two drivers 51 and 52 associated with respective relays 511 and 521. The first driver 51 is employed to actuate the loudspeaker 41 via the first relay 511 to produce a simulative bell sound, and the second driver 52 is employed to actuate a reproduction of music via the second relay 521. The memory unit 23 further has an output (O4) connected to the second driver 52 via a diode so as to actuate the second driver 52 when output (O4) is in high level. The outputs (O1, O2, O3 and O4) of the memory unit 23 are connected to inputs of an OR gate 67 via an acoustic selecting switch 8. The output of the OR gate 67 is connected to the first driver 51 via a diode. Therefore, the user can manually adjust the acoustic selecting switch 8 to determine whether or not to produce a music or a simulative bell sound when the pre-set moment is up, and adjust the memory selector means 7 to choose the storage block in which the desired music software is stored and is outputted when the pre-set moment is up.

Figure 3:
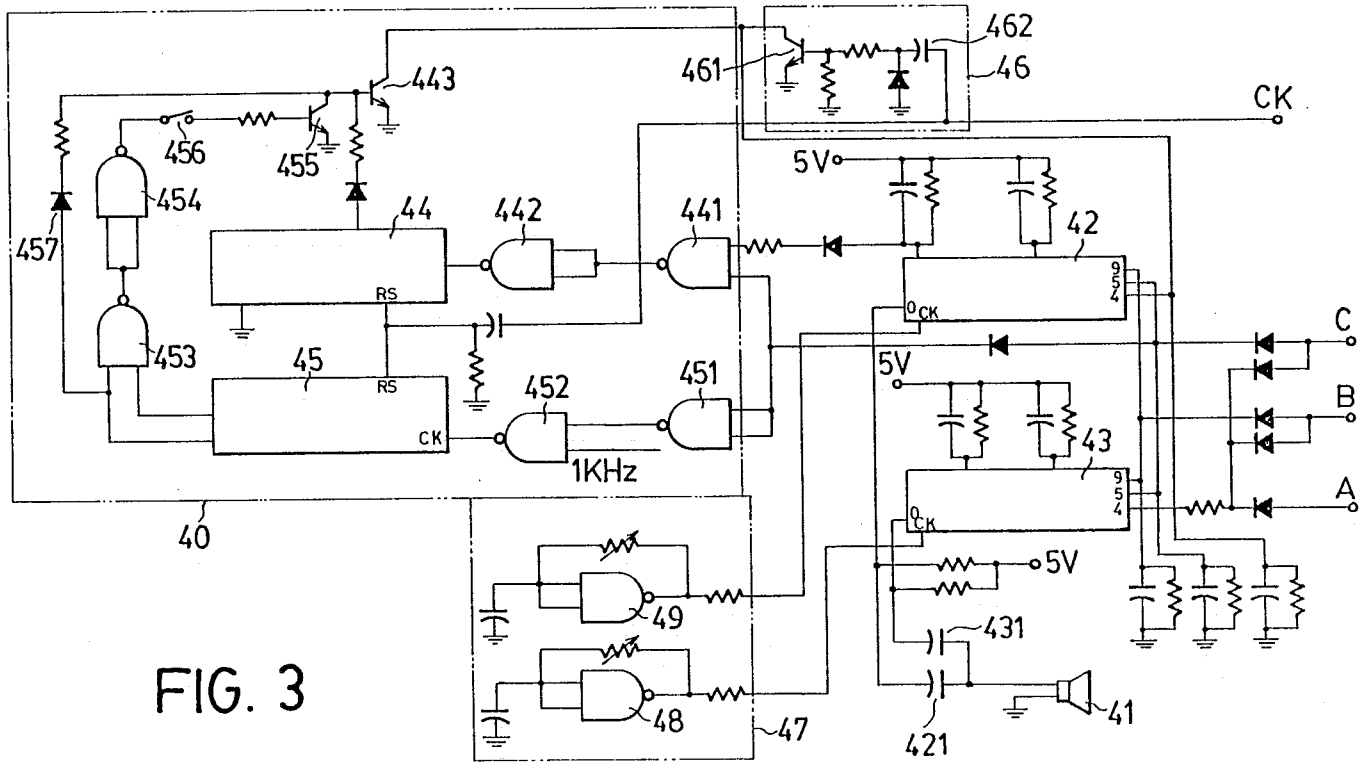
FIG. 3 is a circuit diagram of an acoustic generator for the clock of FIG. 1.

Turning now to FIG. 3, the acoustic generator 4 of this invention is described in detail. The acoustic generator 4 comprises an acoustic repeating circuit 40, two music integrated circuits 42 and 43 storing music software, a reset circuit 46 and a clock generator 47. Respectively actuating inputs (i.e., pins 4,5 and 9) of the first and second music integrated circuits 42 and 43 are connected to the inputs (A, B, and C) of the acoustic generator 4 so that when a signal is inputted into one of the inputs (A, B, and C) from the memory unit 23, the corresponding music software stored in the first or second music integrated circuits 42 or 43 is reproduced via a loudspeaker 41.

The clock generator 47 comprises two NAND gates 48 and 49 serving as oscillators to supply clock signals of different frequency respective to the first and the second music integrated circuits 42 and 43. The outputs of the first and second music integrated circuits 42 and 43 are synthesized by a pair of parallel capacitors 421 and 431 and sent to the loudspeaker 41.

The reset circuit 46 comprises a transistor 461 and a capacitor 462. The collector of the transistor 461 is connected to a respective actuating input (pin 4) of the first and second drivers 42 and 43, and the base of the transistor 461 is connected to one terminal of the capacitor 462. The remaining terminal of the capacitor 462 is connected to the output of the OR gate 57, as shown in FIG. 2, so that the reset circuit 6 clears the first and second drivers 42 and 43 after the acoustic generator 4 is actuated.

The acoustic repeating circuit 40 comprises two repeating counters 44 and 45 associated with a plurality of logic gates (in this exemplary case, six of NAND gates) to connect with the first and second music integrated circuits 42 and 43 for forming a loop to repeatedly produce the desired music software or simulative bell tones. The remaining terminal of the capacitor 462 is further connected to the reset pin of the repeating counters 44 and 45, so that the reset circuit 6 clears the repeating counters 44 and 45 after the acoustic generator 4 is actuated.

The actuating input (pin 5) of the first and second music integrated circuits 42 and 43 is connected to an input of a first NAND gate 441 and to both inputs of a second NAND gate 451 via a diode. The output of the second NAND gate 451 is connected to an input of a third NAND gate 452, the remaining input of which is connected with a clock means which produces a clock signal of 1KHz. The output of the third NAND gate 452 is connected to the clock input of the music repeating clock 45. One output of the music repeating clock 45 is connected via a diode to the base of a transistor 443, the collector of which is connected to the collector of the transistor 461. The outputs of the music repeating clock 45 are connected to the inputs of a fourth NAND gate 453. The outputs of the fourth NAND gate 453 are connected to the inputs of a fifth NAND gate 454. The output of the fifth NAND gate 454 is connected to a base of a transistor 455 via a repeating switch 456. The collector of the transistor 455 is connected to the base of transistor 443. The switching on of the repeating switch 456 actuates the first and second music integrated circuits 42 and 43 in order to repeatedly access the desired music software since the collector off transistor 443 (i.e., the collector of transistor 461) is connected to both the actuating input (pin 4) of the first and second music integrated circuits 42 and 43.

The output of the first NAND gate 441 is connected to both the inputs of a sixth NAND gate 442, the output of which is connected to the clock pin of the bell sound repeating clock 44. The output of the bell sound repeating clock 44 is connected to the base of transistor 443 via a diode. Therefore, the bell sound repeating clock 44 provides clock signals for producing the bell sound and determining the number times of bell tones.

Figure 4:
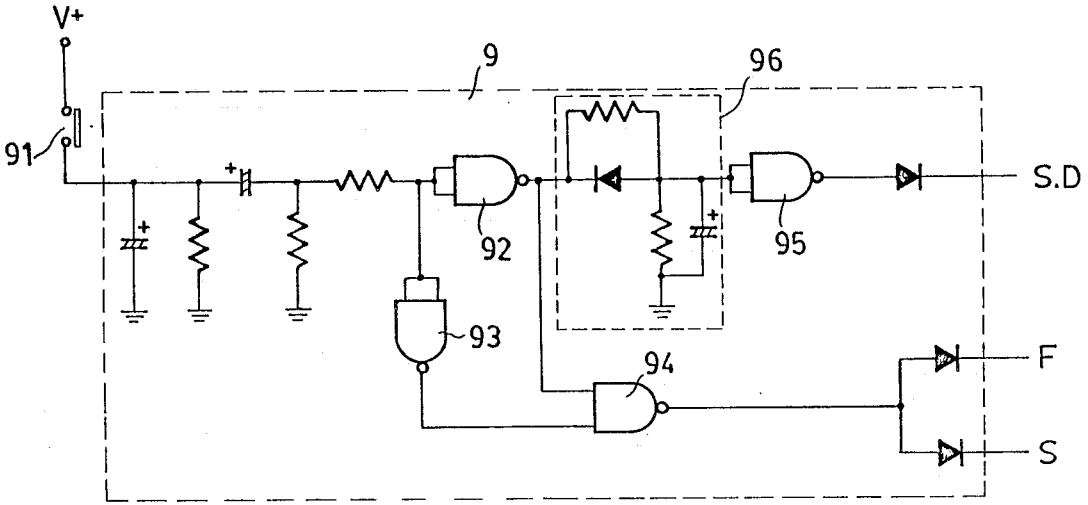
FIG. 4 is a circuit diagram of the time adjustment apparatus of FIG. 1 in accordance with the present invention.

Referring to FIG. 4, the time adjustment apparatus 9 of this invention is described in detail. The time adjustment apparatus 9 comprises a delay circuit 96 and a plurality of (in this exemplary case, four NAND gates) logic gates 92 to 95 and diodes. The actuating contact 91 is connected to both inputs of seventh and eight NAND gates 92 and 93 via a capacitor and a resistor. The outputs of the seventh and eighth NAND gates 92 and 93 are connected to the inputs of a ninth NAND gates 94, of which the outputs in turn are connected to the time-setting switches 102 and 103 indicated by symbols (F) and (S). The output of seventh NAND gate 92 is sent into the delay circuit 96, the output of which is input to a tenth NAND gate 95. The output of the tenth NAND gate 95 is connected to the time-setting switch 101 indicated by symbol (S.D) via a diode.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A digital clock for giving acoustic time-indicating signals at predetermined moments comprising an oscillator, a time integrated circuit driven by said oscillator, a first display means connected to said time integrated circuit to show hour and minute and a second display means connected to said time integrated circuit to show a day among a week, two minute and hour decoders connected to said first display means to convert signals therefrom into a digital form, a memory unit for receiving said signals from said minute and hour decoders, and having a plurality of inputs and outputs and a control pin, a setting circuit comprising a plurality of flip-flops and a control switches connected to said inputs of said memory unit to pre-set said moments when said acoustic time-indicating signals are given;

an acoustic generator and a driving interface connected to respective outputs of said memory unit and driven by said memory unit to output said time-indicating signals, a switching circuit to respectively connect with an output of said second display means and a control pin of said memory unit to disable said memory unit on a day shown on said second display means, and a plurality of time-setting switches connected to said time integrated circuit to manually adjust time shown on said first and second display means.

2. A digital clock as set forth in claim 1, in which said second display means comprises a counter connected to an output of said time integrated circuit, a plurality of light emitting diodes and a button to adjust said day shown on said second display means.

3. A digital clock as set forth in claim 1, further comprising a memory selector means having two switches which are provided to connect address buses of said memory unit to enlarge memory storage blocks, a plurality of music software being respectively stored in each said storage block to be output via said acoustic generator when said pre-set moment is reached.

* * * * *